US006023795A

United States Patent [19]

Pötter et al.

[11] Patent Number: 6,023,795

[45] Date of Patent: Feb. 15, 2000

[54] WASHBASIN DRAIN ASSEMBLY

[75] Inventors: Jochen Pötter, Halstenbek, Germany; Arthur J. McGowan, Jr., Roscoe; Nathan A. Hemmer, Rockford, both of Ill.

[73] Assignee: Evac International Oy, Helsinki, Finland

[21] Appl. No.: 09/057,993

[22] Filed: Apr. 9, 1998

[51] Int. Cl.[7] ..... E03C 1/264

[52] U.S. Cl. ..... 4/652; 4/287; 4/291; 4/292; 4/689; 251/231; 251/245

[58] Field of Search ..... 4/652, 685, 690, 4/689, 684, 287, 289, 290, 291, 292

[56] References Cited

U.S. PATENT DOCUMENTS

| | | | |
|---|---|---|---|
| 989,410 | 4/1911 | Peters | 4/289 |
| 1,161,766 | 11/1915 | Ferran | 4/689 X |
| 1,612,588 | 12/1926 | Lacoste | 4/291 |
| 1,980,280 | 11/1934 | Baxter | 4/690 |
| 2,348,093 | 5/1944 | Pasman | 4/287 |
| 2,859,453 | 11/1958 | Bloch | 4/685 |
| 4,045,351 | 8/1977 | Peterson | 4/652 X |

FOREIGN PATENT DOCUMENTS

| | | | |
|---|---|---|---|
| 1255751 | 1/1961 | France | 4/689 |

*Primary Examiner*—Henry J. Recla
*Assistant Examiner*—Kathleen J. Prunner
*Attorney, Agent, or Firm*—Marshall, O'Toole, Gerstein, Murray & Borun

[57] ABSTRACT

A washbasin drain assembly comprises a drain body which defines a drain passage connecting the interior space of the washbasin to the waste line and a drain plug in cooperative engagement with the drain body for selectively sealing the drain passage. A sieve is fitted removably in the drain body downstream of the plug relative to the direction of flow from the basin to the waste line.

8 Claims, 5 Drawing Sheets

88
100
102
104
106
107
108
112
116

WASHBASIN DRAIN ASSEMBLY

BACKGROUND OF THE INVENTION

This invention relates to a washbasin drain assembly.

Design of subsystems of a commercial passenger aircraft is a continuing pursuit of a favorable balance between functionality and weight.

For several years, the lavatory washbasins in commercial passenger aircraft were generally made from stainless steel. Although stainless steel has many desirable properties with respect to this use, a basin made of stainless steel is heavier than a basin of comparable size and made of a material having a higher strength-to-weight ratio than stainless steel, such as a glass fiber reinforced synthetic polymer material.

In order to provide a basin of sufficient strength made from non-metallic material, the thickness of the basin must generally be greater than the thickness of a basin made of stainless steel.

The drain body that is connected to the outlet opening of the lavatory washbasin in a commercial passenger aircraft is connected to a waste line which supplies the gray water from the basin either to a pressure responsive valve which feeds the gray water to a drain mast for discharge from the aircraft or to a vacuum interface valve for supplying the water to a vacuum sewer through which the water is delivered to a collecting tank aboard the aircraft. In certain applications, there may be other devices downstream of the drain body.

A solid contaminant in the gray water may interfere with operation of the interface valve or other downstream device, and may lead to a flooding condition.

It is known to include a strainer in the outlet of a washbasin to prevent solid objects from entering the drain line. Depending on the installation of the basin, the purpose of the strainer may be either to protect against loss, e.g. of small items of jewelry, or to protect against blockage of the drain line, e.g. by kitchen waste. In either case, however, the strainer openings are fairly large, typically hiving a minimum linear dimension of at least 5 mm.

SUMMARY OF THE INVENTION

It is an object of the invention to provide an improved washbasin drain assembly for a commercial passenger aircraft, wherein the drain assembly is provided with a filter to protect a downstream device, such as a vacuum interface valve, from contamination by objects that might otherwise enter the gray water collection and disposal system through the washbasin, and wherein the filter is positively retained in normal use yet can be selectively removed during routine maintenance for cleaning.

It is also an object of the invention to provide such a washbasin drain assembly in which the filter allows use of either a stopper attached to a chain or other cord-like element or a stopper assembly including a lift rod operated by a draw bar, such that the stopper assembly remains partially within the drain assembly in the open condition.

It is a further object of the invention to provide an improved washbasin drain assembly which can accommodate use in a commercial passenger aircraft of a lavatory washbasin made either of metal, such as stainless steel, or a non-metallic material, such as fiber reinforced synthetic polymer material.

In accordance with a first aspect of the invention there is provided an improved washbasin drain assembly, for fitting in an outlet opening of a washbasin and connecting to a waste line, comprising a drain body which defines a drain passage connecting the interior space of the washbasin to the waste line and a drain plug in cooperative engagement with the drain body for selectively sealing the drain passage, wherein the improvement resides in a sieve fitted removably in the drain body downstream of the plug relative to the direction of flow of liquid from the basin to the waste line.

In accordance with a second aspect of the invention there is provided an improved washbasin drain assembly, for fitting in an outlet opening of a washbasin and connecting to a waste line, comprising a seat which fits in the outlet opening and defines a drain passage surrounded by a flange, a drain body attached to the seat and positioned below the washbasin, a lift member fitted in the drain body and displaceable between an upper position and a lower position, a plug fitted in the drain passage and supported by the lift member, such that when the lift member is in its lower position, the plug engages the seat and seals the washbasin and when the lift member is in its upper position the plug is clear of the seat, and a pivot engaged with the lift member, wherein the improvement resides in that the lift member is adapted to be engaged by the pivot rod selectively in one of at least two locations spaced apart along the lift member, to accommodate possible variation in height of the flange relative to the pivot rod.

In accordance with a third aspect of the invention there is provided an improved washbasin drain assembly, for fitting in a outlet opening of a washbasin and connecting to a waste line, comprising a drain body subassembly which fits in the outlet opening and defines a drain passage connecting the interior space of the washbasin to the waste line, a stopper subassembly fitted in the drain passage and including a plug for sealing the drain passage and a lift member for selectively raising and lowering the plug, and an actuator coupled to the lift member, wherein the improvement resides in that the plug is releasably attached to the lift member, whereby the plug can be disengaged from the lift member to allow removal of the plug without disengaging the lift member from the actuator.

In accordance with a fourth aspect of the invention there is provided an improved washbasin drain assembly for a washbasin mounted in a deck, the drain assembly comprising a drain body for fitting in an outlet opening of a washbasin and connecting to a waste line, a stopper subassembly fitted in the drain body subassembly and movable selectively therein for releasing and preventing flow of liquid from the basin, a pivot rod mounted in the drain body and having an inner end engaged with the stopper subassembly and also having an outer end, a draw bar guide mounted in the deck, a draw bar slidable within the draw bar guide, and a link rod connecting the draw bar to the outer end of the pivot rod, the link rod including a upper vertical segment extending adjacent the draw bar, a lower vertical segment extending toward the pivot rod, and a horizontal segment extending between a lower end of the upper vertical segment and an upper end of the lower vertical segment, to limit encroachment of the link rod on the space below the draw bar.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
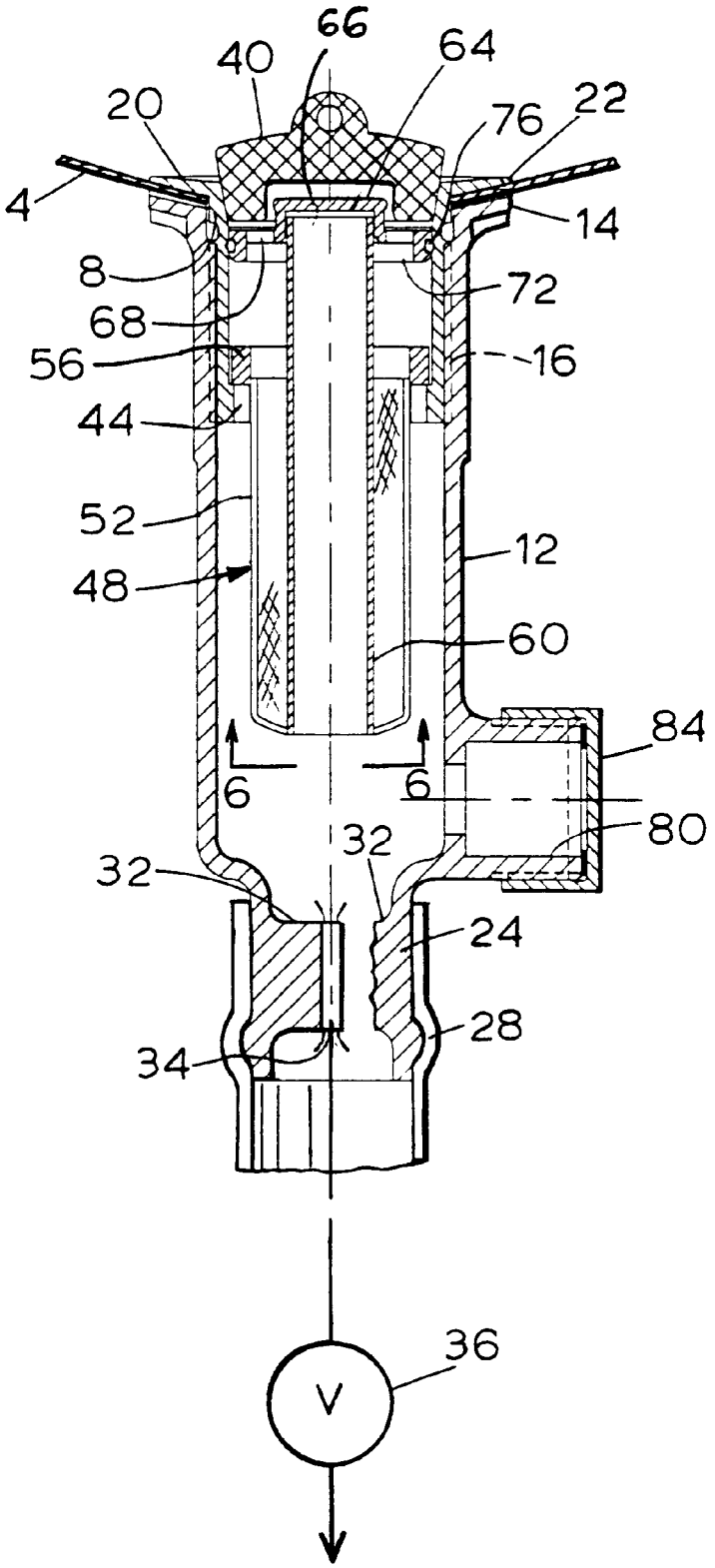
FIG. 1 is a part sectional schematic view of an aircraft washbasin drain assembly in accordance with the invention.

FIG. 1 illustrates a relatively thin washbasin 4 made of a metallic material such as stainless steel and having an inner rim surrounding an outlet opening 8. A drain body 12, which has an external flange 14 and is internally threaded at 16, is positioned below the outlet opening of the washbasin. A seat 20 has a flange 22 above the outlet opening of the basin and an extension sleeve extending through the outlet opening and in threaded engagement with the drain body 12. The annular margin surrounding the outlet opening of the basin is clamped between the flanges 14 and 22, and a gasket is provided to prevent leakage of water between the flange 14 and the underside of the basin. The seat 20 defines a drain passage connecting the interior space of the washbasin to the drain body. At its lower end, the drain body has a connection nipple 24 over which a hose 28, serving as a drain line, is fitted. The nipple defines an outlet conduit which is divided into sectors by four webs 32 projecting inward toward the central axis of the conduit. The four webs 32 do not meet at the center of the outlet conduit, but leave a narrow guideway 34 clear. The hose 28 is connected to a downstream flow control device 36, such as a vacuum interface valve.

A stopper 40, of the kind that is typically attached to a chain so that it can be freely moved relative to the basin within the limits imposed by the length of the chain yet is positively retained, can be fitted in the drain passage defined by the seat 20. When the stopper 40 is fitted in this drain passage, it blocks flow of water from the washbasin whereas when the stopper is removed from the drain passage water can flow from the basin.

Figure 6:
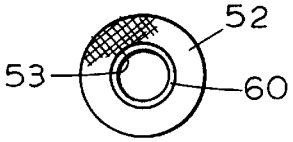
FIG. 6 is an enlarged partial view of the drain assembly taken along line 6—6 of FIG. 1.

The seat 20 has an internal flange or shoulder 44 at the lower end of its extension sleeve. A filter subassembly 48 includes a mesh cup 52 with a circular opening 53 (illustrated in FIG. 6) at its bottom end and an annular rim 56 at its top end, and a tube 60 attached to the cup 52 and extending upward from the circular opening at the bottom of the cup. The filter subassembly 48 is located in the drain body with the annular rim 56 resting on the shoulder 44 so that the tube 60 is coaxial with the drain body 12.

A cap subassembly 64 includes a cap 66 which is attached by an annular web formed with holes 68 to an annular mounting ring 72, carrying an O-ring 76 at its outer periphery. The cap subassembly 64 is releasably secured to the seat 20 by engagement of the O-ring 76 in a V-shaped groove at the interior of the seat. In this position, the cap 66 extends over the opening at the upper end of the tube 60. The cap 66 is configured so that it is awkward for the simply curious to grasp the cap and remove the cap subassembly, but service personnel can readily grasp the cap subassembly and remove it.

The aperture size of the mesh cup 52 depends on the nature and structure of the downstream device to be protected and the nature of the contaminants against which the downstream device is to be protected. Research has shown that the type of debris that is deposited in the lavatory washbasin of a commercial passenger aircraft depends on the route served by the aircraft. Therefore the actual mesh size may depend on the route. If the service of a particular aircraft is changed, the mesh size of the filter to be installed in that aircraft can also be changed. The size may be in the range from 40 $\mu$m to 5 mm, preferably 100 $\mu$m to 2 mm.

When the stopper 40 is removed, water in the basin can flow out through the drain body and outlet conduit and is filtered so that even relatively small particles are trapped in the cup 52. The mounting ring 72 serves as a coarse filter, blocking large objects. During routine servicing, the cap subassembly 64 is removed and the service person can then remove the filter subassembly 48 and either clean it on the spot and reinstall it or can replace it with a clean filter subassembly and take the one removed from the drain body away for cleaning. In this way, the downstream device 36 is protected from contamination with solids in the basin, reducing the likelihood of a malfunction of the downstream device.

The tube 60 is constructed with a solid wall in order to afford sufficient rigidity to allow it to be gripped by service personnel without collapsing the tube.

The drain body has a lateral stub 80 just above the connection nipple 24. The purpose of the lateral stub 80 will be described with reference to FIG. 2. In the case of the drain assembly shown in FIG. 1, the lateral stub is not used and it is sealed by a cap nut 84.

Figure 2:
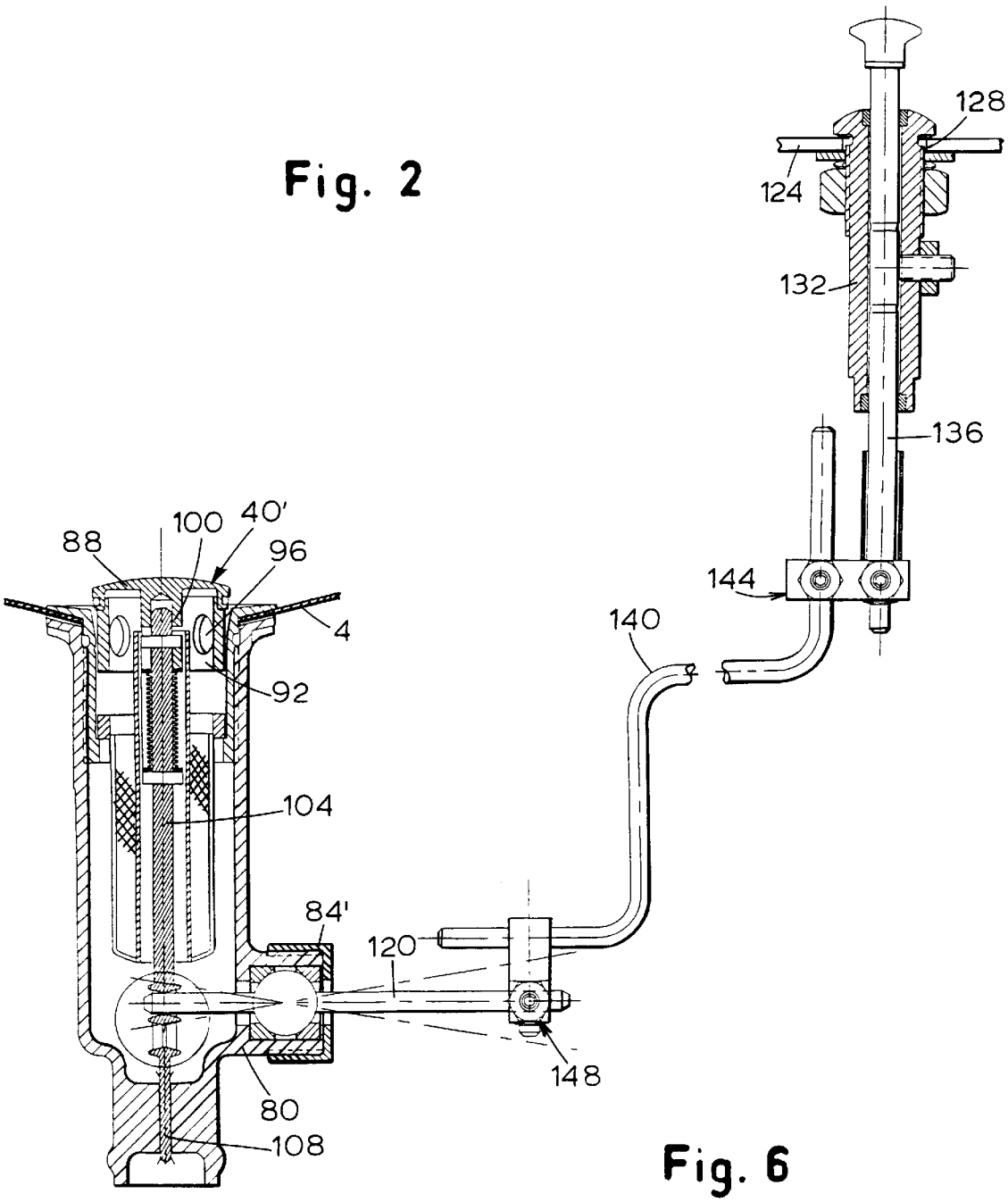
FIG. 2 is a part sectional view of a second aircraft washbasin drain assembly in accordance with the invention.

Referring to FIG. 2, the stopper subassembly 40' includes a circular plug 88 having an annular flange formed with a peripheral groove containing an O-ring. A guide sleeve 92 formed with openings 96 is attached to the plug 88 and extends downward from the annular flange. Inward of the guide sleeve 92, a cylindrical socket 100 formed with inverted J-shaped slots 102 (FIG. 3) projects downward from the plug and is removably coupled to a lift rod 104 which extends axially within the drain body, passing through the tube 60, and has a stem 108 fitted in the guideway 34 and restrained against lateral movement by the guide webs 32.

Figures 3A, 3B, 3C, 3D, 3E, 3F:
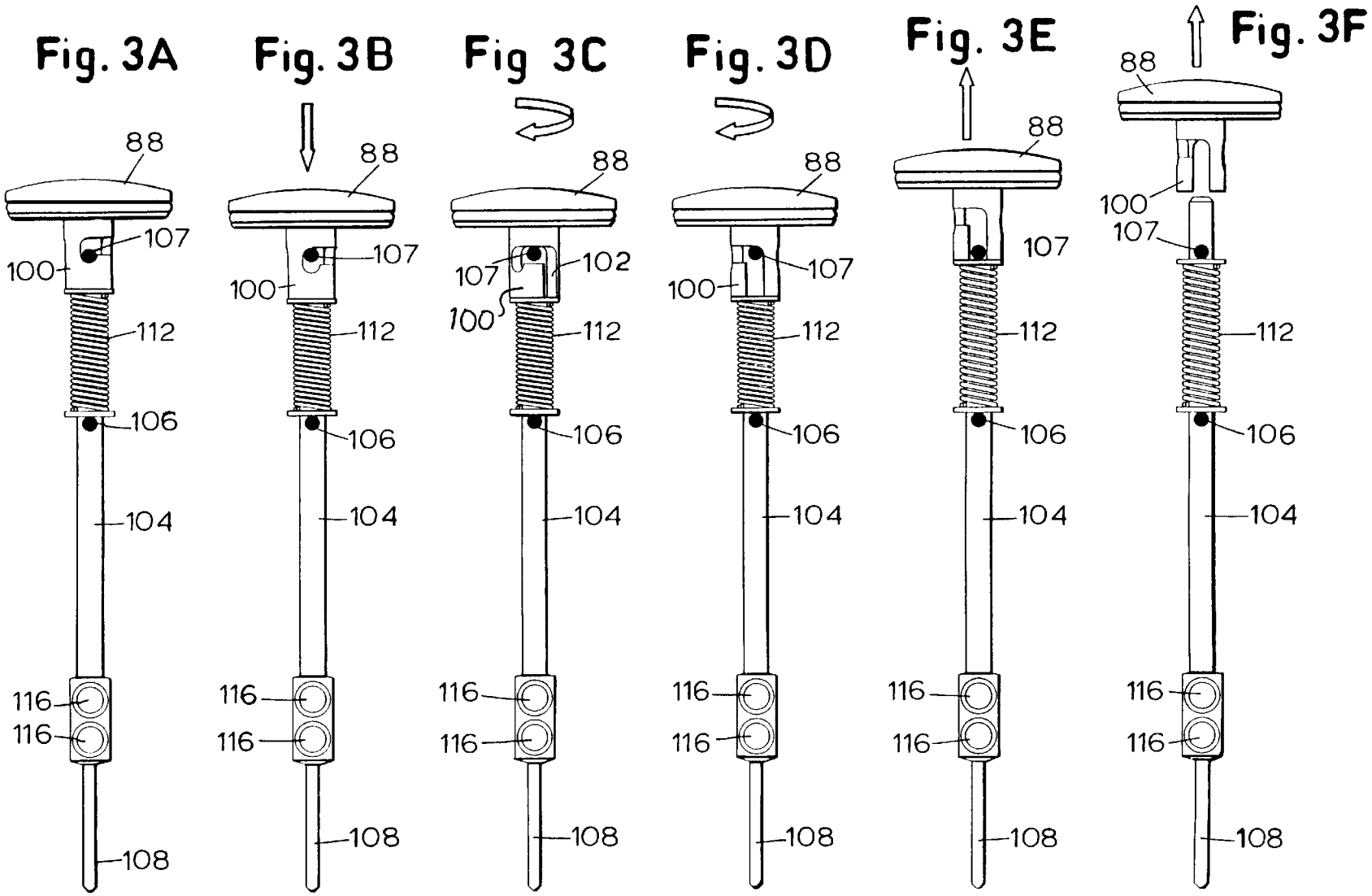
FIGS. 3A–3F are enlarged partial views of a subassembly of the drain assembly shown in FIG. 2, and illustrate the manner in which two components of the subassembly are coupled.

FIG. 3 shows several views of the stopper subassembly 40' in order to illustrate the manner in which the plug 88 is attached to the lift rod 104. The sleeve 92 is not shown in FIG. 3, in order to avoid concealing the socket 100. As shown in FIG. 3, the lift rod 104 is formed with lower and upper transverse bores through which respective pins 106, 107 extend. The upper pin 107 functions as a bayonet pin for coupling the plug 88 to the lift rod 104 by engagement in the J-shaped slots. A spring 112 is captive on the lift rod between the two pins. When the plug 88 is engaged with the lift rod 104, the spring 112 is held in compression between the lower pin 106 and the lower end of the socket 100. In order to remove the filter subassembly, the circular plug 88 is disengaged from the lift rod 104 by pressing down on the plug and rotating it clockwise through 90° in order to align the upper pin 107 with the slots 102. The plug can then be removed from the seat, exposing the filter subassembly.

Just above the guide stem 108, the lift rod 104 is formed with two transverse openings 116. A pivot rod 120 extends through a ball journalled in the lateral stub 80, the ball being held captive by a cap nut 84', the pivot rod 120 having an inner end which threads the upper opening 116. Angular movement of the pivot rod 120 about a horizontal axis is transmitted through the lift rod to the plug 88, which can be raised toward an open position, in which it is clear of the seat 20 and water can flow from the basin into the drain body, and lowered toward a closed position in which it seals the drain passage. The guide sleeve 92 serves to guide movement of the plug 88 relative to the seat 20 and the openings 96 prevent large particles from entering the drain body 12.

The coupling of the lift rod 104 to the pivot rod 120 and the coupling of the plug 88 to the lift rod 104 provide positive retention of the plug 88 and lift rod 104.

The filter is designed to maximize the filter area within the space available in the drain body 12. The available space is limited by the lift rod and the connection, to the pivot rod. In a practical implementation, the cup is about 5.5 cm long and about 2.3 cm in diameter.

The basin 4 is mounted in a deck 124 (FIG. 2). Spaced somewhat from the rim of the basin 4 is a circular opening 128 in the deck and a draw bar guide 132 is fitted in this opening and is held in position by a nut. The draw bar guide 132 defines a circular bore through which a draw bar 136, provided at its upper end with an actuator knob, is fitted slidably. A detent mechanism cooperating with peripheral grooves in the draw bar establishes two principal operating positions (open and closed) for the draw bar.

A linkage rod 140 has upper and lower vertical segments and inner and outer (with respect to the drain body 12) horizontal segments. At its lower end, the draw bar L36 is provided with a clamp 144 having a first jaw which grips the lower end of the draw bar 136 and a second jaw which grips the upper vertical segment of the linkage rod 140. The upper clamp 144 holds the upper vertical segment of the linkage rod substantially parallel to the draw bar. The upper clamp can be attached to the draw bar at any angular position about the axis of the draw bar and it can also be attached to the upper vertical segment of the linkage rod at any angular position about a vertical axis. Further, the vertical position at which the upper clamp grips the upper segment of the linkage rod is adjustable. The inner horizontal segment of the linkage rod is attached to the pivot rod 120 by a lower clamp 148, which can be attached to the pivot rod and the inner horizontal segment of the linkage rod at any horizontal position. The lower clamp includes a swivel allowing the angular position of the inner horizontal segment relative to the pivot rod to vary about a vertical axis. Play in the connection between the linkage rod and the pivot rod allows limited angular relative movement of the inner horizontal segment and the pivot rod about a horizontal axis perpendicular to the lift rod. This arrangement of the linkage rod and the upper and lower clamps provides wide flexibility in location of the draw bar guide 132 relative to the basin 4. Because the lower vertical segment connects the inner and outer horizontal segments, the linkage rod does not encroach substantially on the space immediately below the draw bar, leaving this space available for other equipment.

Figure 4B:
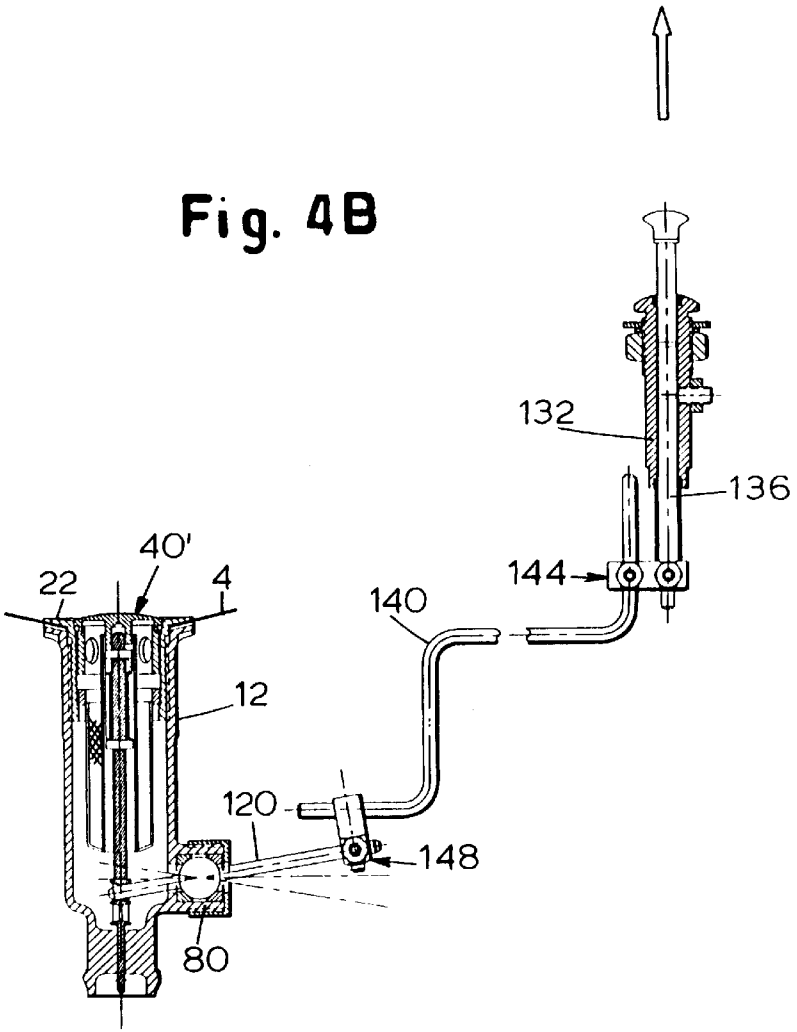
FIGS. 4A and 4B show the washbasin drain assembly of FIG. 2 in open and closed conditions respectively.
Figure 4A:
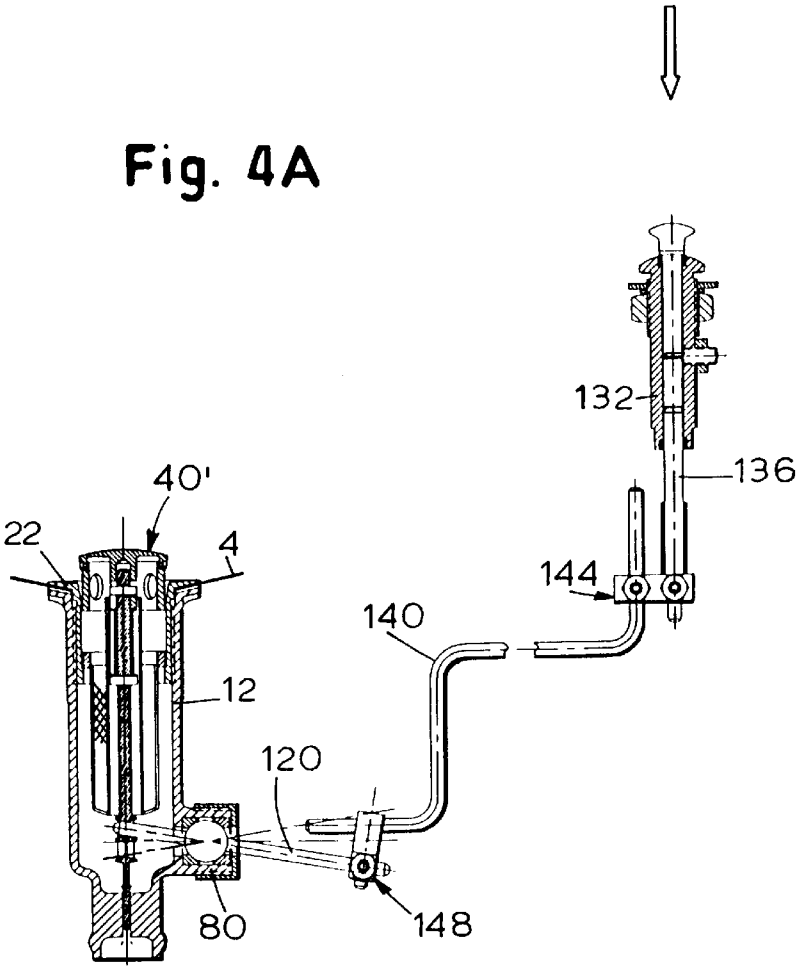

FIGS. 4A and 4B illustrate the drain assembly of FIG. 2 in the open and closed conditions respectively.

In a conventional domestic washbasin, the drain body is attached to the basin by a mounting nut in threaded engagement with the drain body. In the case of the drain assembly shown in FIGS. 1 and 2, the annular margin of the basin is clamped between the flanges of the seat 20 and the drain body 12. This is advantageous in an aircraft application because it avoids the need for the mounting nut, which adds weight and is a potential source of failure due to the possibility of loosening through vibration. However, because the annular margin of the basin 4 is clamped between the flanges of the seat 20 and the drain body 12, the vertical position of the lateral stub 80 relative to the seat 20 depends on the thickness of the basin.

Figure 5B:
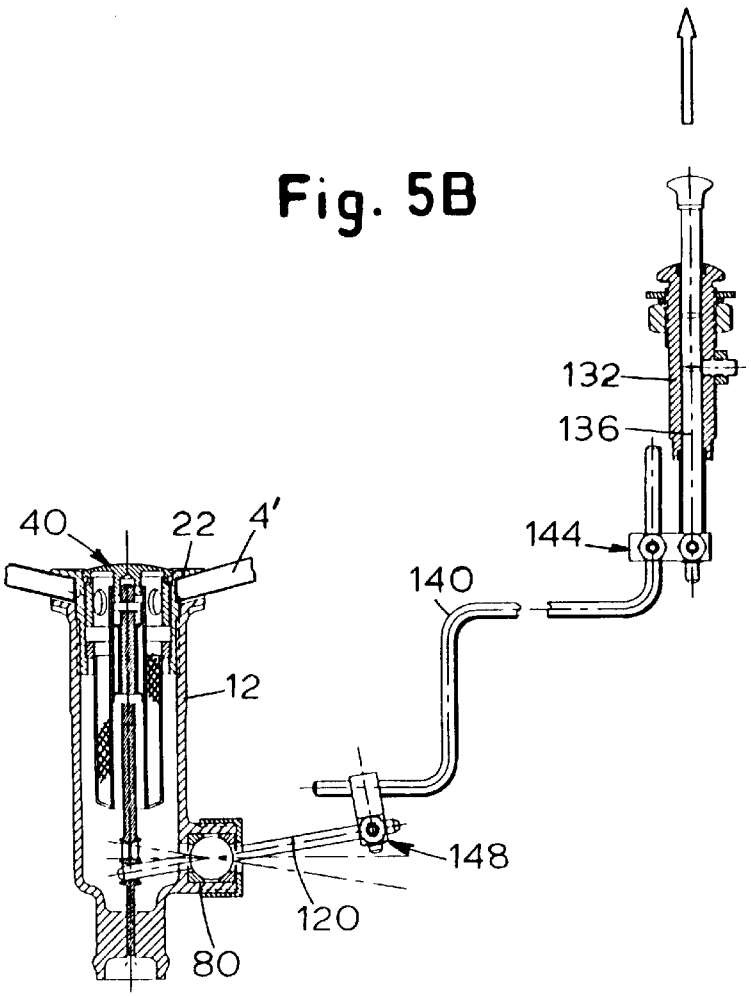
FIGS. 5A and 5B illustrate the drain assembly of FIG. 2 when modified to fit in a thicker washbasin, in open and closed conditions respectively.
Figure 5A:
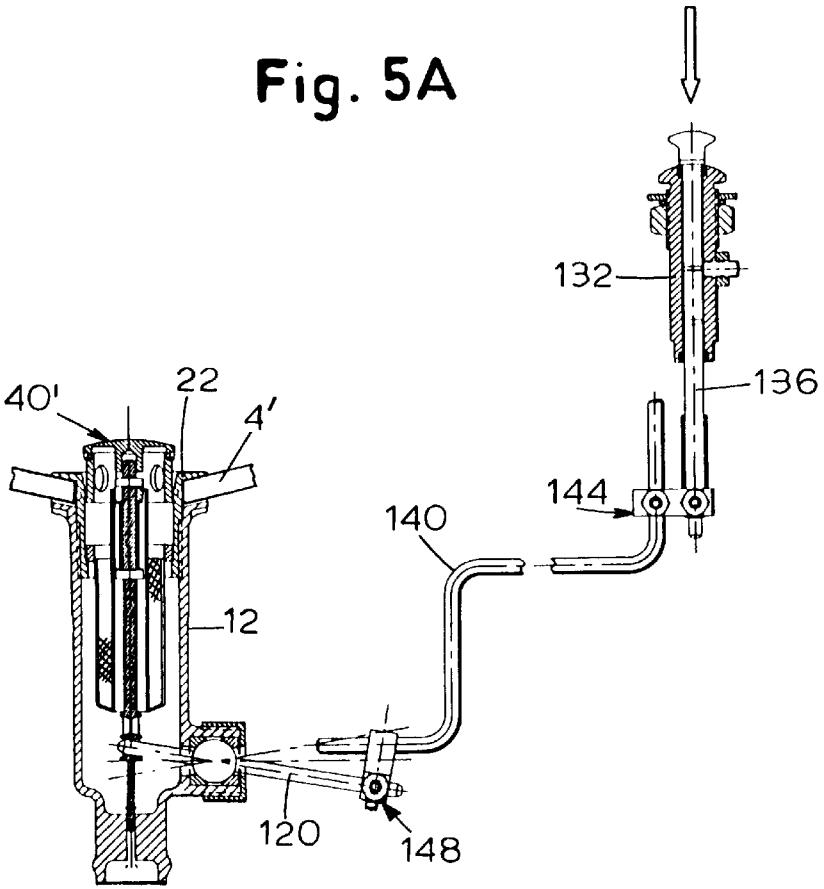

Referring to FIGS. 5A and 5B, the thickness of the basin 4' is significantly greater than the thickness of the basin 4 shown in FIGS. 4A and 4B and so the flange 22 of the seat 20 is higher relative to the drain body 12. The vertical distance between the flange 22 of the seat 20 and the lateral stub 80 is significantly greater in the case of FIGS. 5A and 5B than in the case of FIGS. 4A and 4B. Accordingly, the range of movement through which the stopper subassembly 40' must move in order to lift the plug is shifted upward relative to the arrangement shown in FIGS. 4A and 4B. In order to elevate the lift rod and accommodate the greater thickness of the basin 4', the inner end of the pivot rod is fitted in the lower opening 116, as shown in FIGS. 5A and 5B. It will therefore be seen that use of two openings 116 in the lift rod allows the same drain assembly to be used not only with a thin basin made of metal but also with a thicker basin, such as one made of a glass fiber reinforced synthetic polymer material.

It will be appreciated that the invention is not restricted to the particular embodiment that has been described, and that variations may be made therein without departing from the scope of the invention as defined in the appended claims and equivalents thereof. For example, although the invention has been described with reference to a washbasin installed in a passenger aircraft, it is also applicable to other installations, particularly mobile installations such as trains, buses and ships.

What is claimed:

1. An improved washbasin drain assembly, for fitting in an outlet opening of a washbasin and connecting to a waste line, the outlet opening defining an annular inner margin, the washbasin drain assembly comprising a drain body which defines a drain passage sized to extend from the interior space of the washbasin to the waste line, a drain plug in cooperative engagement with the drain passage for opening and closing the drain passage, a sieve fitted removably in the drain body downstream of the drain plug relative to a direction of flow of liquid from the basin to the waste line, the sieve including a mesh cup having a circular opening at its lower end and a tube extending upward from the opening, a seat having a flange sized to extend over the annular inner margin of the outlet opening, and a lift rod extending through the tube and coupled to the drain plug to open and close the drain passage.

2. A drain assembly according to claim 1, wherein the sieve has a mesh size range from 40 $\mu$m to 5 mm.

3. A drain assembly according to claim 1, further comprising a sleeve extending downward from the flange into the drain body, the seat supporting the sieve in the drain body.

4. A drain assembly according to claim 3, wherein the sleeve includes an inward shoulder and the sieve includes a rim resting on the shoulder.

5. An improved washbasin drain assembly, for fitting in an outlet opening of a washbasin and connecting to a waste line, comprising a seat sized to fit in the outlet opening, the seat defining a drain passage surrounded by a flange, a drain body attached to the seat and adapted to extend below the washbasin, a lift member fitted in the drain body and displaceable between an upper position and a lower position, a plug fitted in the drain passage and supported by the lift member, such that when the lift member is in its lower position, the plug engages the seat and seals the drain passage and when the lift member is in its upper position the plug is clear of the seat, and a pivot rod engaged with the lift member, wherein the improvement resides in that the lift member is adapted to be engaged by the pivot rod selectively in one of at least two locations spaced apart along the lift member, to accommodate possible variation in height of the flange relative to the pivot rod.

6. A drain assembly according to claim 5, wherein the lift member is an elongate rod extending within the drain body and formed with at least an upper transverse hole and a lower transverse hole, and the pivot rod is mounted to the drain body and has an inner end engageable selectively with either the upper transverse hole or the lower transverse hole.

7. An improved washbasin drain assembly, for fitting in an outlet opening of a washbasin and connecting to a waste line, the washbasin drain assembly comprising a drain body subassembly sized to fit in the outlet opening, the drain body subassembly defining a drain passage sized to extend from the interior space of the washbasin to the waste line, a stopper subassembly fitted in the drain passage and including a plug for sealing the drain passage and a lift member for selectively raising and lowering the plug, an actuator coupled to the lift member, a transverse pin extending from an upper end of the lift member, the plug having an inverted J-shape slot sized to receive the transverse pin thereby to releasably attach the plug to the lift member, the plug has a downwardly dependent socket sized to accept the upper end of the lift member, the slot being formed in the socket, and a spring disposed about the upper end of the lift member and having an upper end adapted to engage a lower edge of the socket, whereby the plug can be disengaged from the lift member to allow removal of the plug without disengaging the lift member from the actuator.

8. An improved washbasin drain assembly for fitting in a washbasin and connecting to a waste line, the washbasin being mounted in a deck and having an outlet opening, the drain assembly comprising a drain body sized to fit in the outlet opening of the washbasin and defining a drain passage sized to extend from the outlet opening to the waste line, a stopper subassembly fitted in the drain body and movable selectively therein for opening and closing the drain passage, a pivot rod mounted in the drain body and having an inner end engaged with the stopper subassembly and also having an outer end, a draw bar guide mounted in the deck, a draw bar slidable within the draw bar guide, and a link rod connecting the draw bar to the outer end of the pivot rod, the link rod including an upper vertical segment extending adjacent the draw bar, a lower vertical segment extending toward the pivot rod, and a horizontal segment extending between a lower end of the upper vertical segment and an upper end of the lower vertical segment, to limit encroachment of the link rod on the space below the draw bar.

* * * * *